US008261784B2

(12) United States Patent
Gerard et al.

(10) Patent No.: US 8,261,784 B2
(45) Date of Patent: Sep. 11, 2012

(54) METHOD AND SYSTEM FOR PREVENTING A FUEL DISPENSING SYSTEM FROM DISPENSING INAPPROPRIATE FUEL TO A VEHICLE

(75) Inventors: Dale A. Gerard, Bloomfield Hills, MI (US); Melissa A Schulz, Royal Oak, MI (US)

(73) Assignee: GM Global Technology Operations LLC

( * ) Notice: Subject to any disclaimer, the term of this patent is extended or adjusted under 35 U.S.C. 154(b) by 888 days.

(21) Appl. No.: 12/237,655

(22) Filed: Sep. 25, 2008

(65) Prior Publication Data

US 2010/0065147 A1 Mar. 18, 2010

Related U.S. Application Data

(60) Provisional application No. 61/097,297, filed on Sep. 16, 2008.

(51) Int. Cl.
*B65B 1/30* (2006.01)

(52) U.S. Cl. ..... 141/94; 141/83; 141/98; 141/192

(58) Field of Classification Search ..... 141/59, 141/83, 94, 98, 192, 197
See application file for complete search history.

(56) References Cited

U.S. PATENT DOCUMENTS

| | | | | |
|---|---|---|---|---|
| 4,263,945 | A * | 4/1981 | Van Ness | 141/98 |
| 4,469,149 | A * | 9/1984 | Walkey et al. | 141/94 |
| 5,209,275 | A * | 5/1993 | Akiba et al. | 141/83 |
| 5,605,182 | A * | 2/1997 | Oberrecht et al. | 141/94 |
| 7,523,770 | B2 * | 4/2009 | Horowitz et al. | 141/94 |
| 7,597,252 | B1 * | 10/2009 | Dewitt | 235/381 |
| 2006/0196571 | A1 * | 9/2006 | Kassner | 141/94 |

* cited by examiner

*Primary Examiner* — Timothy L Maust

(57) ABSTRACT

A method and system for dispensing fuel to a vehicle includes a sensor generating a fuel identifier signal associated with the vehicle and a fuel dispenser having a fuel type a fuel type selector generating a fuel type selector signal. The system also includes a control module in communication with the sensor and the fuel dispenser. The control module compares the fuel identifier with fuel type. When the fuel type corresponds to the fuel identifier, the control module enables a dispensing of fuel from the fuel dispenser. When the fuel type does not correspond to the fuel identifier, the control module prevents the dispensing of fuel.

16 Claims, 2 Drawing Sheets

METHOD AND SYSTEM FOR PREVENTING A FUEL DISPENSING SYSTEM FROM DISPENSING INAPPROPRIATE FUEL TO A VEHICLE

CROSS-REFERENCE TO RELATED APPLICATIONS

This application claims the benefit of U.S. Provisional Application No. 61/097,297, filed on Sep. 16, 2008. The disclosure of the above application is incorporated herein by reference.

TECHNICAL FIELD

The present disclosure relates generally to a system for dispensing fuel to a vehicle, and more particularly, to a method and system for preventing a fuel dispensing system from dispensing inappropriate fuels to a vehicle.

BACKGROUND

The statements in this section merely provide background information related to the present disclosure and may not constitute prior art.

The automotive industry is increasing investigation and implementations of alternative fuels. As alternative fuels become available, there is a potential for customers to use them in vehicles that are not designed to operate on the particular fuel. If the wrong fuel is dispensed into a vehicle, damage may occur to the vehicle. One type of fuel being implemented is ethanol. Many vehicles currently are capable of using E85. The fuel E85 is 85% denatured ethanol and 15% gasoline. One type of gasoline that is widely available is E10. E10 is 10% denatured alcohol and 90% gasoline. Most vehicles in the marketplace today can run on E10. Other blends of ethanol, such as E20, E30 and E50 are also being investigated by automobile manufacturers and ethanol producers.

Typically, vehicles designed to run on ethanol fuel may operate with 100% gasoline or another blend with a higher amount of ethanol. For example, an E85 vehicle is capable of operating with ethanol blends E10, E30 and E50 and E85. However, 100 percent gasoline may also be used. Vehicles, small engine equipment and marine applications calibrated to run on regular gasoline or E10 may not run properly if higher blends, such as E20, E30, E50 and E85 are used. In addition running higher ethanol blends in vehicles designed for regular gasoline and E10 can cause further damage because these blends are not compatible with some of the components such as seals and valve seats amongst other items, and can the vehicle's emission's catalysts be poisoned and rendered ineffective. This is true for other types of fuel, such as methanol, butanol, biodiesel, B5 which is a 5 percent blend of biodiesel and diesel and B20 which is a 20 percent blend of biodiesel and diesel. As the number of alternative fuels increases, there is opportunity for confusing the various fuel types and blend levels.

SUMMARY

The present disclosure provides a system and method to prevent the dispensing of fuels into a vehicle not suited for the fuel.

In one aspect of the disclosure, a method includes communicating a fuel identifier signal from a sensor associated with a vehicle to a fuel dispensing system having a fuel type and comparing the fuel identifier to the fuel type. When the fuel type corresponds to the fuel identifier, the method includes dispensing fuel from the fuel dispensing system. When the fuel type does not correspond to the fuel identifier, the method includes preventing the dispensing of fuel.

In another aspect of the disclosure, a system includes a sensor generating a fuel identifier signal associated with a vehicle and a fuel dispenser having a fuel type a fuel type selector generating a fuel type selector signal. The system also includes a control module in communication with the sensor and the fuel dispenser. The control module compares the fuel identifier with fuel type. When the fuel type corresponds to the fuel identifier, the control module enables a dispensing of fuel from the fuel dispenser. When the fuel type does not correspond to the fuel identifier, the control module prevents the dispensing of fuel.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
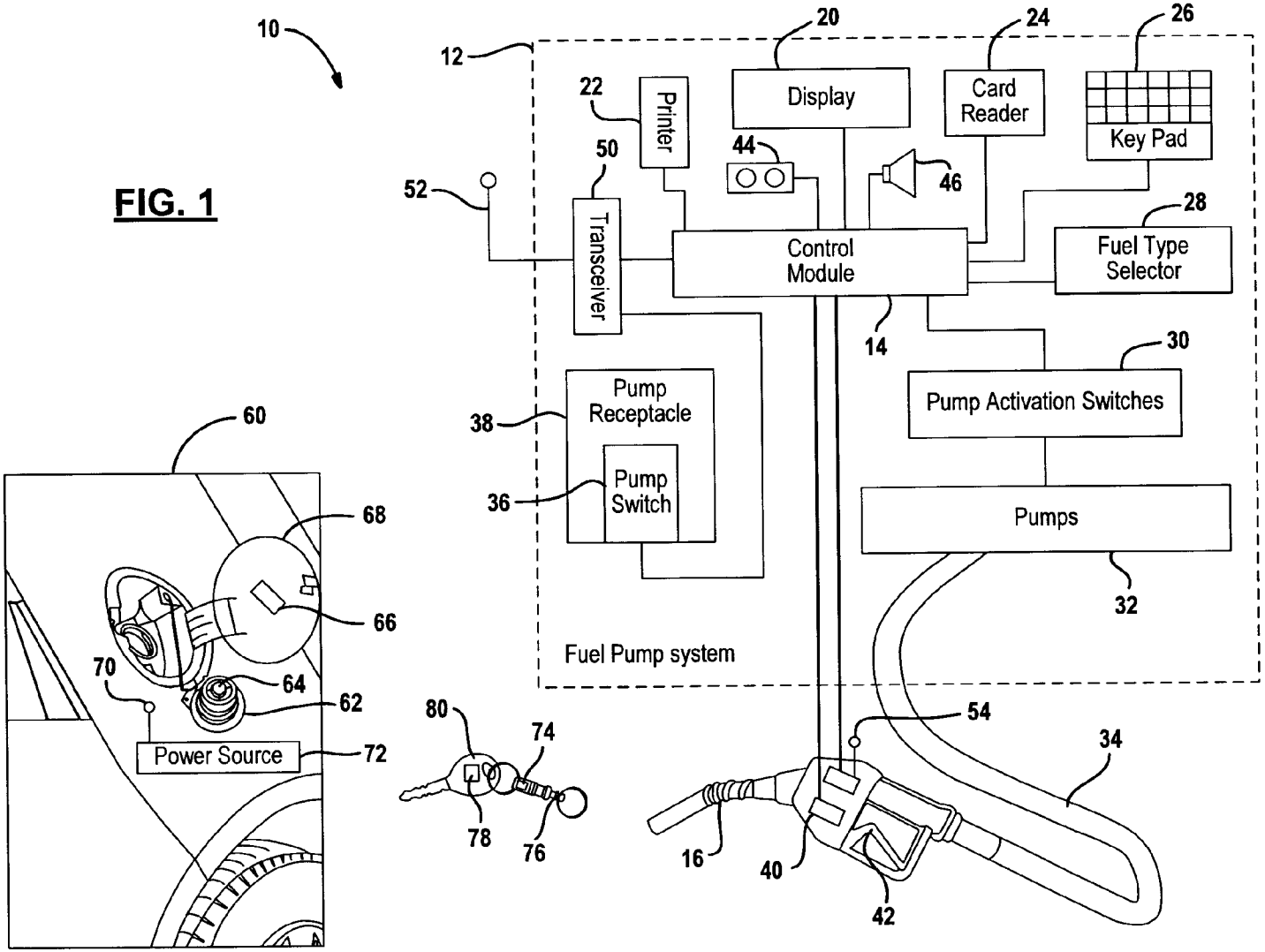
FIG. 1 is a block diagrammatic view of a fuel dispensing system according to the present disclosure.

The following description is merely exemplary in nature and is not intended to limit the present disclosure, application, or uses. For purposes of clarity, the same reference numbers will be used in the drawings to identify similar elements. As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality. As used herein, the phrase at least one of A, B, and C should be construed to mean a logical (A or B or C), using a non-exclusive logical or. It should be understood that steps within a method may be executed in different order without altering the principles of the present disclosure.

While the following disclosure is made with respect to automobiles, other types of vehicles may benefit including airplanes, ships, and watercraft.

Referring now to FIG. 1, a fuel dispensing system 10 includes a fuel dispenser 12 that includes a control module 14. The control module 14 may be micro-processor-based and have a memory therein. The control module 14 includes logic for performing various tasks including comparing signals.

The control module 14 is in communication with a plurality of components for dispensing fuel from a fuel nozzle 16. The control module 14 may be associated with a display 20 that is used to display data signals. For example, the display 20 may include the number of gallons, and dollars associated with the particular transaction. Other types of data may also be displayed on the display 20, such as various warnings or messages. Some of the messages will be further described below. The display 20 may include but are not limited to liquid crystal or light emitting diodes.

The control module 14 may also be associated with a printer 22 for printing a receipt for a particular transaction. A card reader 24 may also be in communication with the control module 14. The card reader 24 may be a magnetic stripe reader for reading debit cards and credit cards. The card reader 24 may also be a proximity-type reader that reads the codes of the credit card when the credit card is placed in close proximity to the card reader 24.

The control module 14 may also have a keypad 26 associated therewith. The keypad 26 may be used for various functions including answering questions displayed on the display 20. The keypad 26 may also be used for entering personal identification numbers, or the like.

The control module 14 may also be associated with a fuel type selector 28. The fuel type selector 28 may be formed in various ways including a plurality of switches or a single switch. A plurality of switches selects a particular type. A fuel type signal may thus be communicated by the fuel type selector 28 to the control module 14. Many switches, each corresponding to a particular fuel type may be used.

The control module 14 may be used to activate a pump activation switch 30 used to activate a particular pump for a particular one of the pumps 32 for pumping one of a number of fuels through the fuel nozzle 16 through the fuel hose 34. A pump switch 36 may also be in communication with the control module 14. The pump switch 36 may generate a pump switch signal as one condition for the control module 14 enabling the activation of the pumps 32.

A nozzle switch 40 in communication with a nozzle handle 42 may also be used to activate the pumps 32 upon predetermined conditions as will be further described below.

An indicator or plurality of indicators may also be associated with the control module 14. The indicators may include a visual indicator 44 such as a light or an audible indicator that is generated from a buzzer or speaker 46. The display 20 may also be part of the visual display and display messages or the like.

The control module 14 may also be in communication with a transceiver 50. The transceiver 50 may be associated with an antenna 52 on the fuel dispenser 12. Although the antenna 52 is illustrated extending from the housing, the antenna 52 may be incorporated within a body of the fuel dispenser 12. The transceiver 50 may also be associated with an antenna 54 on the nozzle 16. Once again, the antenna 54 is illustrated extending from the nozzle. However, the antenna 54 may be built into the nozzle 16 or handle. It should be noted that the transceiver 50 may be replaced by a transmitter and receiver and that the antennas 52, 54 may be replaced by a transmitting antenna and a receiving antenna.

The transceiver 50 may be used to generate a radio frequency (RF) signal from one of the antennas 52, 54 having an energy sufficient to obtain a response from a sensor associated with an automotive vehicle 60. The automotive vehicle 60 may include one or more sensors at various locations within the vehicle 60. Only one sensor is needed. Different vehicles may have sensors in different positions.

A sensor 62 may be located on or embedded within a fuel cap 64. Another suitable location for a sensor 66 is on the fuel door. The sensor 66 may be located on or embedded within the fuel door 68. In the case of the sensors 64 and 66, both may be powered by the RF energy generated by one of the antennas 52, 54.

Another location for a sensor 70 is proximate one of the body panels. The sensor 70 may be located in a body panel, on a body panel, or embedded within one of the body panels of the vehicle. Also, the sensor 70 may be located in the interior of the vehicle and embedded in one of the trim panels, or the like. Another suitable location for the sensor 70 may be in exterior plastic trim. For example, the sensor 70 may be embedded within bumper coverings or molding. The sensor 70 may also be energized by the signals from the antennas 52, 54. However, the sensor 70 may also be in communication with a power source 72 within the vehicle. The power source 72 may include the vehicle battery. In the case of a powered sensor 70, the transceiver 50 may merely be a receiver used for receiving a signal from the sensor 62, 66, 70. The transceiver 50 through prompting from the control module 14 may generate a query signal from one of the antennas 52, 54. A sensor 74 associated with the vehicle may be incorporated into a remote keyless entry fob 76. A sensor 78 may incorporated into a key 80.

The sensors 64, 66, 70, 74, 76 may be various types of sensors including but not limited to a transponder or an RF identification tag. The sensors 64, 66, 70, 74, 76 may also be retroactively fitted to a vehicle. The sensors 64, 66, 70, 74, 76 may be provided to vehicle owners after purchase. Gas caps with sensors may be easily replaced. Adhesively backed RF identification tags may be provided to owners to be applied to the inside of a fuel filler door.

A response signal from a sensor 62, 66, 70, 74 or 78 may be generated that includes a fuel identifier signal used to identify the suitable type or types of fuel for the vehicle. For example, the identifier signal may identify that E85 and blends having more than 15 percent gasoline with various amounts of ethanol are acceptable. Of course, only one fuel may be identified such as E85. The control module 14 may then use logic to determine a group of suitable fuels. The control module 14 may thus enable or disable various types of fuel from being dispensed from the fuel dispenser 12. For example, when a fuel type at the selector 28 is selected that does not correspond to the fuel identifier, the fuel corresponding to the fuel type may not be pumped by the fuel dispenser 12. When the fuel type of the fuel type selector corresponds to the fuel identifier, fuel may be dispensed from the fuel dispenser 12.

Figure 2:
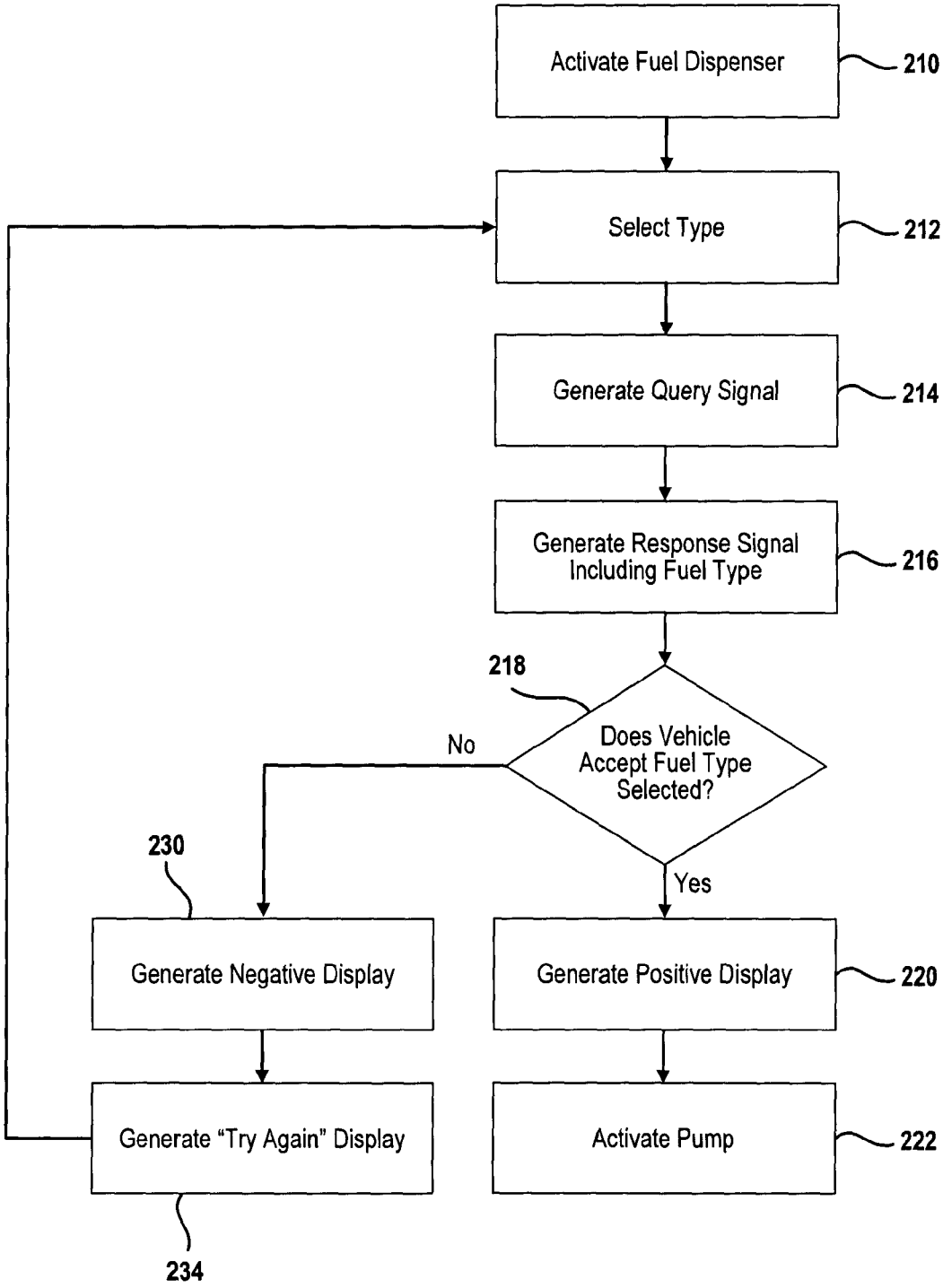
FIG. 2 is a flowchart of a method for the fuel dispensing system.

Referring now to FIG. 2, a method for operating the fuel dispensing system is illustrated. In step 210, the fuel dispenser is activated. This may be performed by removing the fuel nozzle 16 from the pump receptacle 38 of FIG. 1. The pump switch 36 may activate the pump. The transaction portion, such as credit card reading or receiving other types of payment, may be performed using the keypad to also activate the pump.

In step 212, a type of fuel is selected using the fuel type selector 28 of FIG. 1. Selections from the key pad may also to form a fuel selection. One of many different types of fuel types may be selected by the fuel type selector 28.

In step 214, a query signal is generated from the transceiver and ultimately from one of the antennas 52 or 54. The antennas 52, 54 may generate an RF signal that is used to solicit a response from the sensor. In step 216, a response signal including a suitable fuel type or types is communicated from one of the sensors 62, 68, 70, 76, 78 back to the control module 14 through the antennas 52, 54 and transceiver 50.

In step 218, it is determined whether or not the vehicle accepts the fuel selected by the fuel type selector 28. The control module 14 may perform a comparison of the fuel type selector signal and the fuel identifier signal from one of the sensors. When the fuel type signal corresponds to the fuel identifier signal, the fuel may be dispensed to the vehicle. When the fuel type does not correspond to the identifier, fuel may be prevented from being dispensed to the vehicle. A comparison within the control module 14 may also include receiving a number of different types of fuels that are acceptable to the vehicle for comparison with the fuel type selector signal. Further, the control module 14 may also perform logic that expands the amount of types of fuel based on one fuel identifier associated with the sensor. For example, a vehicle capable of E85 may also be capable of accepting fuels with lower ethanol values including 100% gasoline.

In step 220, a positive display may be generated if the vehicle does accept the fuel selected. The positive display may be an audible display on the display 20, the indicators 44 or an audible display 46. One or more of the displays may be activated at any particular time. Generating the positive display may be an optional step. In step 222, the pump may be activated that is associated with the particular fuel type selected when the vehicle does accept the fuel. By activating the pump, fuel is provided to the vehicle. This may be performed with movement of nozzle handle 42

Referring back to step 218, if the vehicle does not accept the fuel type selected, step 230 may be performed. In step 230, a negative display message may be generated by the display 20, the indicator 44 or an audible display 46. The display may be a message such as "The grade of fuel is not compatible with this vehicle".

In step 234, a "try again" indicator or "select another type" indicator may be provided through one of the displays 20, 44, 46. After step 234, the process may return to step 212 when a new fuel type is selected.

As described in the above description, the present disclosure prevents fuel dispensing errors in an environment where an ever-increasing amount of fuels are being dispensed at fueling stations. The present disclosure may also be used for various other types of vehicles, including aircraft, buses, ships, or the like. As alternative fuels become available for other modes of transportation, the present disclosure may prevent fueling errors in those types of vehicles as well.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification and the following claims.

What is claimed is:

1. A method comprising:

receiving a fuel type identifier from a sensor implemented within a fuel cap of a vehicle at a fuel dispenser;

receiving, at the fuel dispenser, an indicator of a type of fuel selected by a user at the fuel dispenser;

receiving, at the fuel dispenser, indicators of a number of different types of fuels that are acceptable for the vehicle;

comparing the type of fuel selected by the user with the different types of fuels that are acceptable for the vehicle;

when the type of fuel selected by the user corresponds to at least one of the different types of fuels that are acceptable for the vehicle, dispensing fuel from the fuel dispenser; and when the type of fuel selected by the user does not correspond to at least one of the different types of fuels that are acceptable for the vehicle, preventing dispensing fuel from the fuel dispenser.

2. A method as recited in claim 1 further comprising communicating the fuel type identifier in response to a query signal.

3. A method as recited in claim 2 further comprising communicating the fuel type identifier in response to the query signal from an antenna proximate a nozzle.

4. A method as recited in claim 2 further comprising communicating the fuel type identifier in response to the query signal from an antenna proximate the fuel dispenser.

5. A method as recited in claim 1 further comprising when the type of fuel selected by the user does not correspond to at least one of the different types of fuels that are acceptable for the vehicle, generating an indicator.

6. A method as recited in claim 5 wherein generating the indicator comprises generating an audible indicator.

7. A method as recited in claim 5 wherein generating the indicator comprises generating a visual indicator.

8. A method as recited in claim 1 further comprising determining, at said fuel dispenser, said different types of fuels that are acceptable for the vehicle based on said fuel type identifier.

9. A system comprising:

a sensor that is implemented within a fuel cap of a vehicle and that generates fuel type identifier;

a fuel dispenser; and a control module in communication with the sensor and the fuel dispenser, said control module receiving an indicator of a type of fuel selected by a user at the fuel dispenser, receiving indicators of a number of different types of fuels that are acceptable for the vehicle, comparing the type of fuel selected by the user with the different types of fuels that are acceptable for the vehicle, when the type of fuel selected by the user corresponds to at least one of the different types of fuels that are acceptable for the vehicle, said control module enabling a dispensing of the fuel type from the fuel dispenser, and when the type of fuel selected by the user does not correspond to at least one of the different types of fuels that are acceptable for the vehicle, said control module preventing the dispensing of the fuel type.

10. A system as recited in claim 9 further comprising an indicator in communication with the control module, said control module activating the indicator when the type of fuel selected by the user does not correspond to at least one of the different types of fuels that are acceptable for the vehicle.

11. A system as recited in claim 10 wherein the indicator comprises an audible indicator.

12. A system as recited in claim 10 wherein the indicator comprises a visual indicator.

13. A system as recited in claim 9 further comprising a transceiver communicating a query signal to the sensor, said sensor generating the fuel type identifier in response to the query signal.

14. A system as recited in claim 13 further comprising an antenna in communication with the fuel dispenser, said antenna transmitting the query signal and receiving the fuel type identifier.

15. A system as recited in claim 14 wherein the antenna transmitting the query signal is disposed at a fuel nozzle.

16. A system as recited in claim 9, wherein said control module further determines said different types of fuels that are acceptable for the vehicle based on said fuel type identifier.

* * * * *